United States Patent [19]

Clough et al.

[11] Patent Number: 4,801,329

[45] Date of Patent: Jan. 31, 1989

[54] METAL VALUE RECOVERY FROM CARBONACEOUS ORES

[75] Inventors: Thomas J. Clough, Santa Monica; John W. Sibert, Malibu; Arthur C. Riese, Toluca Lake, all of Calif.

[73] Assignee: Ensci Incorporated, Chatsworth, Calif.

[21] Appl. No.: 25,069

[22] Filed: Mar. 12, 1987

[51] Int. Cl.[4] ..... C22B 11/04

[52] U.S. Cl. ..... 75/97 A; 75/2; 75/101 R; 75/105; 75/118 R; 75/121; 423/22; 423/27; 423/29; 423/30; 423/31

[58] Field of Search ..... 75/97 A, 101 R, 2, 103, 75/104, 105, 111, 115, 118 R, 121; 423/27, 29, 30, 31, 22

[56] References Cited

U.S. PATENT DOCUMENTS

| | | | |
|---|---|---|---|
| 4,421,724 | 12/1983 | Hunnel | 423/29 |
| 4,545,816 | 10/1985 | Rappas | 423/27 |
| 4,552,589 | 11/1985 | Mason et al. | 423/29 |

FOREIGN PATENT DOCUMENTS

| | | | |
|---|---|---|---|
| 0177295 | 4/1986 | European Pat. Off. | 423/30 |

*Primary Examiner*—Robert L. Stoll
*Attorney, Agent, or Firm*—Frank J. Uxa

[57] ABSTRACT

A process for recovering a first metal, e.g., gold, from a carbonaceous ore comprising contacting the ore with an added metal component other than an alkali metal or alkaline earth metal component in an amount effective to at least promote the oxidation of carbonaceous material in the ore, the contacting occurring at conditions effective to (1) chemically oxidize at least a portion of the carbonaceous material, and (2) at least partially liberate the first metal from the ore; and recovering the first metal from the ore.

31 Claims, No Drawings

METAL VALUE RECOVERY FROM CARBONACEOUS ORES

This invention relates to a process for recovering at least one first metal, e.g., gold, from an ore containing the first metal and carbonaceous material. In particular, the invention relates to a process for recovering the first metal which involves processing the first metal, carbonaceous material-containing ore so as to facilitate the recovering of the first metal from the ore.

Carbonaceous ores, i.e., ores which contain elemental carbon (e.g., graphite) and/or organic compounds, often contain valuable metals, such as gold, silver, the platinum group metals and the like. Once characteristic of such ores which has made them difficult and expensive to process is that the presence of carbon and organic compounds inhibits metal recovery using conventional, e.g., cyanide, processing. In other words, the presence of organic material in such carbonaceous ores tends to interfere with metal extraction, e.g., by cyanidation. For example, a substantial amount of carbonaceous ore is not amenable to conventional cyanidation techniques because of the presence of carbon (which often acts like activated carbon), and relatively long chained organic hydrocarbon-type compounds containing sulfur, nitrogen, carboxylic acid groups and the like.

Various procedures have been investigated in an attempt to enhance metal recovery from these difficult-to-process ores, including roasting, kerosene pretreatment, flotation and aqueous chlorination. These measures are either substantially ineffective to increase metal recovery from carbonaceous ores or are relatively expensive and involve processing with chlorine and chlorinated components which are often corrosive or otherwise difficult to handle. See: B. J. Schermer, et al. "Processing Refractory Carbonaceous Ores for Gold Recovery," Journal of Metals, March, 1971, pp. 37–40; D. Raicevic and R. W. Bruce, "Gold Recovery from a Refractory Carbonaceous Gold Ore," Canadian Mining Journal, March, 1976, pp. 40–45; W. J. Guay, "How Carlin Treats Gold Ores by Double Oxidation," World Mining, March, 1980, pp. 47–49; and J. A. Eisele, et al., "Recovery of Gold and Silver from Ores by Hydrometallurgical Processing," Separation Science and Technology, 18 (12 and 13), pp. 1081–1094, 1983.

There is a growing world-wide interest in metal recovery from carbonaceous ores. Thus, in spite of the substantial work which has been done to provide for such metal recovery, a need currently exists to provide for a process for metal recovery from carbonaceous ores.

Therefore, one object of the invention is to provide a process for recovery of at least one first metal from ores containing the first metal and carbonaceous material, i.e., carbonaceous ores.

Another object of this invention is to provide a process to improve the effectiveness of conventional metal recovery procedures, in particular cyanidation, using carbonaceous ores. Other objects and advantages of the present invention will become apparent hereinafter.

A process for recovering at least one first metal, in particular gold, from at least one ore containing the first metal and carbonaceous material has been discovered. In a broad aspect, the process comprises contacting the carbonaceous ore with at least one added metal component other than alkali and alkaline earth metal components in an amount effective to at least promote the oxidation of the carbonaceous material. The contacting occurs at conditions effective to (1) chemically oxidize at least a portion of the carbonaceous material, and (2) at least partially liberate the first metal from the ore. The first metal is then recovered from the ore. In one embodiment, at least one additional oxidant is present during the contacting. This additional oxidant is present in an amount effective to provide at least one of the following: maintain at least partially the promoting activity of the added metal component; produce at least a portion of the added metal component; and/or oxidize at least a portion of the carbonaceous material. The preferred added metal components (promoters) have been found to be soluble redox catalysts which have sufficient oxidizing potential to either oxidize carbon and/or to activate the additional oxidant to oxidize carbon in the carbonaceous ore. The additional oxidant can provide a reservoir of oxidizing capacity which enhances the overall rate of oxidation and ultimate recovery of the first metal. The added metal component is preferably selected from the group consisting of iron components, soluble manganese (predominating in plus three (3+) components and mixtures thereof. The various embodiments of this invention can be practiced singly or in any combination of embodiments, with selection and optimization generally being a function of the ore type and desired metal value recovered.

The present invention provides substantial benefits. For example, improved yields of first metal are often achieved under less severe conditions by practicing the present process, especially when compared to recovering first metal from the carbonaceous ore without utilizing the present process of this invention. The present process is relatively easy to operate and control. Relatively low concentrations of added promoters are used and relatively mild operating conditions may be employed. Operating and capital costs are often reduced relative to previous chlorination/oxidation procedures which require substantial amounts of chemicals and/or expensive metallurgy to combat corrosion problems. Thus, the present invention can provide a cost effective approach to recovery of first metal from carbonaceous ores.

The process of the present invention is useful for metal recovery from carbonaceous ores, as defined above. Recovery of preferred first metals such as gold, silver, the platinum group metals and mixtures thereof, in particular gold, can be achieved. A large number of ore bodies and large amounts of carbonaceous ores are susceptible to be treated in accordance with the present process. Examples of such ores include: oxidized and carbonaceous ores from various locations in north central and northeastern Nevada, such as the Carlin ore, Jerritt Canyon ore, the Cortez ore and the Witwatersrand ore; ores from the Prestea and Ashanti gold fields in Ghana; the Natalkinsk and Bakyrichik ores from the Soviet Union; various Canadian ores such as the gold ore from the McIntyre Mine, located near Schamacher, Ontario; and the like ones. The carbonaceous ores may include oxidized ore material, possibly even a major amount of oxidized ore material. Also, the carbonaceous ores may contain metal pyrites. However, in another embodiment, the carbonaceous ore which contains metal pyrites can be processed for pyrite removal by physical and/or chemical means to reduce the pyrite content of the ore prior to the contacting step of the present invention. For example, subjecting the ore to various procedures such as grinding, particle size fractionation, flotation and the like can reduce the amount of metal pyrites in the core.

The present process employs at least one added metal component other than alkali and alkaline earth metal components. Such metal components may include alkali and/or alkaline earth metals provided that they also contain one or more additional metals which are effective in the present invention. Such added metal components are present during the contacting step in an amount effective to at least promote the oxidation of the carbonaceous material in the ore. Thus, such added metal components are present in an amount effective to promote the oxidation of the carbonaceous material and/or to oxidize the carbonaceous material.

Without wishing to limit the invention to any specific theory of operation, it is believed that the added metal promoters, preferably soluble and in combination with an added oxidant, oxidizes the carbon surface and/or oxidatively decarboxylates the long chain hydrocarbon components which have gold cyanide absorbing and/or complexing properties, to allow for example, cyanide to complex with the gold and be elected to improve ultimate metal recovery; the process effectively reduces the tendency of the carbonaceous material to absorb and/or complex with the gold electing complex.

The added metal component is preferably selected from the group consisting of iron components, copper components, cobalt components, vanadium components, manganese plus three components and mixtures thereof. More preferably, the added metal component enhances the oxidizing potential of the metal component and is selected from the group consisting of iron components in which iron is present in the 3+ oxidation states in an amount effective to at least promote the oxidation of the ore's carbonaceous material, copper components in which copper is present in an amount in the 2+ oxidation state effective to at least promote the oxidation of the ore's carbonaceous material, cobalt components in which cobalt is present in an amount in the 2+ oxidation state effective to at least promote the oxidation of the ore's carbonaceous material, vanadium components in which vanadium is present in the 3+ or 5+ oxidation states in an amount effective to at least promote the oxidation of the ore's carbonaceous material, manganese components in which manganese is present in the 3+ oxidation state in an amount effective to at least promote the oxidation of the ore's carbonaceous material, and mixtures thereof.

In one embodiment, the iron, copper and cobalt, vanadium and manganese components are soluble and preferably selected from iron complexes with ligands, copper complexes with ligands, and cobalt complexes with ligands, vanadium components with ligands, manganese components with ligands, and mixtures thereof. Such complexes preferably include at least a portion, more preferably a major portion and still more preferably substantially all, of the metal in the preferred oxidation state noted above.

Examples of iron complexes useful in the present invention include iron complexes with polyfunctional amines, for example, ethylenediamine, propylene diamine, ethanol amine, glycine and asparagine and salts thereof; phosphonic acids and phosphonic acid salts, for example, ethane-1-hydroxy-1,1-diphosphonic acid; pyridine and substituted, chelating pyridine derivatives, for example, 1,10-phenanthroline, 2,2'-bipyridyl, glyoxime and salicylaldehyde derivatives; aquo; and CN—. Particularly preferred iron complexing agents for use in the present invention are those selected from the group consisting of substituted chelating derivatives of pyridine, aquo, CN- and mixtures thereof.

Examples of copper complexes useful in the present invention are copper, in particular copper 2+, complexes with pyridine, 1,10-phenanthroline, imidazole, substituted, non-chelating derivatives thereof and mixtures thereof. These derivatives include substituents such as hydroxy, carboxy, amino, alkyl and argyl groups.

Cobalt, in particular cobalt 2+, complexes of chelating Schiff's bases are preferred. These ligands include, for example, ligands uitlizing 1,2 diamines, 1,3-diamines, substituted 1,2-dionemonoximes, substituted 1,3-dionemonoximes, substituted salicylaldehydes and mixtures thereof, such as bis-(salicylaldehyde)ethylenediimine and bis(2,3-butandionemonoxime) ethylenediimine. Examples of vanadium and manganese complexes involving oxyanions are sulfate, nitrate and carboxylates, e.g., acetates.

Especially suitable salt forms of complexing agents are the potassium, sodium and ammonium salts. Mixtures of complexing compounds can be very desirably employed.

As will be recognized by those skilled in the art, the stability of the complexes formed will often be affected by the pH of the aqueous composition employed in the present contacting step. Some stability of the complex or complexes may have to be sacrificed because of the pH of the aqueous composition during the contacting which pH may be preferred for various processing reasons. This reduced complex stability has surprisingly been found not to have an undue adverse effect on oxidation. The particular pH employed can also affect the salt form of the complexing agent employed, and such complexing salts are complexing agents within the scope of this invention.

The present contacting occurs at conditions effective to (1) chemically oxidize at least a portion of the carbonaceous material in the ore and (2) at least partially liberate the first metal from the ore. By "liberated from the ore" is meant that the desired first metal in the ore after the present contacting can be more effectively recovered using conventional (e.g., cyanide extraction) processing relative to the uncontacted ore. In certain instances, at least a portion of the carbonaceous material in the ore normally acts in a manner akin to activated carbon to "pick-up" the first metal after it has been extracted by cyanidation, thus impeding or reducing the overall recovery or yield of the first metal. The term "liberated from the ore" is meant to include reducing this "activated carbon" and/or the complexing effect to provide improved yields of first metal in the metal recovery step, i.e., the first metal becomes more amenable to recovery. This contacting preferably leads to a metal recovery step which involves reduced operating and capital costs and/or provides increased yields of first metal relative to recovering first metal from an uncontacted ore. The present contacting preferably acts to oxidize carbonaceous material in the ore, render an increased amount (relative to uncontacted ore) of the first metal in the ore amenable to conventional (cyanide extraction) metal recovery, and provide for a more effective and/or effective first metal recovery step.

The present contacting preferably takes place in the presence of an aqueous medium or composition. The added metal component or components, which are preferably soluble in the aqueous medium, may be added to

METAL VALUE RECOVERY FROM CARBONACEOUS ORES

This invention relates to a process for recovering at least one first metal, e.g., gold, from an ore containing the first metal and carbonaceous material. In particular, the invention relates to a process for recovering the first metal which involves processing the first metal, carbonaceous material-containing ore so as to facilitate the recovering of the first metal from the ore.

Carbonaceous ores, i.e., ores which contain elemental carbon (e.g., graphite) and/or organic compounds, often contain valuable metals, such as gold, silver, the platinum group metals and the like. Once characteristic of such ores which has made them difficult and expensive to process is that the presence of carbon and organic compounds inhibits metal recovery using conventional, e.g., cyanide, processing. In other words, the presence of organic material in such carbonaceous ores tends to interfere with metal extraction, e.g., by cyanidation. For example, a substantial amount of carbonaceous ore is not amenable to conventional cyanidation techniques because of the presence of carbon (which often acts like activated carbon), and relatively long chained organic hydrocarbon-type compounds containing sulfur, nitrogen, carboxylic acid groups and the like.

Various procedures have been investigated in an attempt to enhance metal recovery from these difficult-to-process ores, including roasting, kerosene pretreatment, flotation and aqueous chlorination. These measures are either substantially ineffective to increase metal recovery from carbonaceous ores or are relatively expensive and involve processing with chlorine and chlorinated components which are often corrosive or otherwise difficult to handle. See: B. J. Schermer, et al. "Processing Refractory Carbonaceous Ores for Gold Recovery," Journal of Metals, March, 1971, pp. 37–40; D. Raicevic and R. W. Bruce, "Gold Recovery from a Refractory Carbonaceous Gold Ore," Canadian Mining Journal, March, 1976, pp. 40–45; W. J. Guay, "How Carlin Treats Gold Ores by Double Oxidation," World Mining, March, 1980, pp. 47–49; and J. A. Eisele, et al., "Recovery of Gold and Silver from Ores by Hydrometallurgical Processing," Separation Science and Technology, 18 (12 and 13), pp. 1081–1094, 1983.

There is a growing world-wide interest in metal recovery from carbonaceous ores. Thus, in spite of the substantial work which has been done to provide for such metal recovery, a need currently exists to provide for a process for metal recovery from carbonaceous ores.

Therefore, one object of the invention is to provide a process for recovery of at least one first metal from ores containing the first metal and carbonaceous material, i.e., carbonaceous ores.

Another object of this invention is to provide a process to improve the effectiveness of conventional metal recovery procedures, in particular cyanidation, using carbonaceous ores. Other objects and advantages of the present invention will become apparent hereinafter.

A process for recovering at least one first metal, in particular gold, from at least one ore containing the first metal and carbonaceous material has been discovered. In a broad aspect, the process comprises contacting the carbonaceous ore with at least one added metal component other than alkali and alkaline earth metal components in an amount effective to at least promote the oxidation of the carbonaceous material. The contacting occurs at conditions effective to (1) chemically oxidize at least a portion of the carbonaceous material, and (2) at least partially liberate the first metal from the ore. The first metal is then recovered from the ore. In one embodiment, at least one additional oxidant is present during the contacting. This additional oxidant is present in an amount effective to provide at least one of the following: maintain at least partially the promoting activity of the added metal component; produce at least a portion of the added metal component; and/or oxidize at least a portion of the carbonaceous material. The preferred added metal components (promoters) have been found to be soluble redox catalysts which have sufficient oxidizing potential to either oxidize carbon and/or to activate the additional oxidant to oxidize carbon in the carbonaceous ore. The additional oxidant can provide a reservoir of oxidizing capacity which enhances the overall rate of oxidation and ultimate recovery of the first metal. The added metal component is preferably selected from the group consisting of iron components, soluble manganese (predominating in plus three (3+) components and mixtures thereof. The various embodiments of this invention can be practiced singly or in any combination of embodiments, with selection and optimization generally being a function of the ore type and desired metal value recovered.

The present invention provides substantial benefits. For example, improved yields of first metal are often achieved under less severe conditions by practicing the present process, especially when compared to recovering first metal from the carbonaceous ore without utilizing the present process of this invention. The present process is relatively easy to operate and control. Relatively low concentrations of added promoters are used and relatively mild operating conditions may be employed. Operating and capital costs are often reduced relative to previous chlorination/oxidation procedures which require substantial amounts of chemicals and/or expensive metallurgy to combat corrosion problems. Thus, the present invention can provide a cost effective approach to recovery of first metal from carbonaceous ores.

The process of the present invention is useful for metal recovery from carbonaceous ores, as defined above. Recovery of preferred first metals such as gold, silver, the platinum group metals and mixtures thereof, in particular gold, can be achieved. A large number of ore bodies and large amounts of carbonaceous ores are susceptible to be treated in accordance with the present process. Examples of such ores include: oxidized and carbonaceous ores from various locations in north central and northeastern Nevada, such as the Carlin ore, Jerritt Canyon ore, the Cortez ore and the Witwatersrand ore; ores from the Prestea and Ashanti gold fields in Ghana; the Natalkinsk and Bakyrichik ores from the Soviet Union; various Canadian ores such as the gold ore from the McIntyre Mine, located near Schamacher, Ontario; and the like ones. The carbonaceous ores may include oxidized ore material, possibly even a major amount of oxidized ore material. Also, the carbonaceous ores may contain metal pyrites. However, in another embodiment, the carbonaceous ore which contains metal pyrites can be processed for pyrite removal by physical and/or chemical means to reduce the pyrite content of the ore prior to the contacting step of the present invention. For example, subjecting the ore to various procedures such as grinding, particle size fractionation, flotation and the like can reduce the amount of metal pyrites in the core.

The present process employs at least one added metal component other than alkali and alkaline earth metal components. Such metal components may include alkali and/or alkaline earth metals provided that they also contain one or more additional metals which are effective in the present invention. Such added metal components are present during the contacting step in an amount effective to at least promote the oxidation of the carbonaceous material in the ore. Thus, such added metal components are present in an amount effective to promote the oxidation of the carbonaceous material and/or to oxidize the carbonaceous material.

Without wishing to limit the invention to any specific theory of operation, it is believed that the added metal promoters, preferably soluble and in combination with an added oxidant, oxidizes the carbon surface and/or oxidatively decarboxylates the long chain hydrocarbon components which have gold cyanide absorbing and/or complexing properties, to allow for example, cyanide to complex with the gold and be elected to improve ultimate metal recovery; the process effectively reduces the tendency of the carbonaceous material to absorb and/or complex with the gold electing complex.

The added metal component is preferably selected from the group consisting of iron components, copper components, cobalt components, vanadium components, manganese plus three components and mixtures thereof. More preferably, the added metal component enhances the oxidizing potential of the metal component and is selected from the group consisting of iron components in which iron is present in the 3+ oxidation states in an amount effective to at least promote the oxidation of the ore's carbonaceous material, copper components in which copper is present in an amount in the 2+ oxidation state effective to at least promote the oxidation of the ore's carbonaceous material, cobalt components in which cobalt is present in an amount in the 2+ oxidation state effective to at least promote the oxidation of the ore's carbonaceous material, vanadium components in which vanadium is present in the 3+ or 5+ oxidation states in an amount effective to at least promote the oxidation of the ore's carbonaceous material, manganese components in which manganese is present in the 3+ oxidation state in an amount effective to at least promote the oxidation of the ore's carbonaceous material, and mixtures thereof.

In one embodiment, the iron, copper and cobalt, vanadium and manganese components are soluble and preferably selected from iron complexes with ligands, copper complexes with ligands, and cobalt complexes with ligands, vanadium components with ligands, manganese components with ligands, and mixtures thereof. Such complexes preferably include at least a portion, more preferably a major portion and still more preferably substantially all, of the metal in the preferred oxidation state noted above.

Examples of iron complexes useful in the present invention include iron complexes with polyfunctional amines, for example, ethylenediamine, propylene diamine, ethanol amine, glycine and asparagine and salts thereof; phosphonic acids and phosphonic acid salts, for example, ethane-1-hydroxy-1,1-diphosphonic acid; pyridine and substituted, chelating pyridine derivatives, for example, 1,10-phenanthroline, 2,2'-bipyridyl, glyoxime and salicylaldehyde derivatives; aquo; and CN—. Particularly preferred iron complexing agents for use in the present invention are those selected from the group consisting of substituted chelating derivatives of pyridine, aquo, CN- and mixtures thereof.

Examples of copper complexes useful in the present invention are copper, in particular copper 2+, complexes with pyridine, 1,10-phenanthroline, imidazole, substituted, non-chelating derivatives thereof and mixtures thereof. These derivatives include substituents such as hydroxy, carboxy, amino, alkyl and argyl groups.

Cobalt, in particular cobalt 2+, complexes of chelating Schiff's bases are preferred. These ligands include, for example, ligands uitlizing 1,2 diamines, 1,3-diamines, substituted 1,2-dionemonoximes, substituted 1,3-dionemonoximes, substituted salicylaldehydes and mixtures thereof, such as bis-(salicylaldehyde)ethylenediimine and bis(2,3-butandionemonoxime) ethylenediimine. Examples of vanadium and manganese complexes involving oxyanions are sulfate, nitrate and carboxylates, e.g., acetates.

Especially suitable salt forms of complexing agents are the potassium, sodium and ammonium salts. Mixtures of complexing compounds can be very desirably employed.

As will be recognized by those skilled in the art, the stability of the complexes formed will often be affected by the pH of the aqueous composition employed in the present contacting step. Some stability of the complex or complexes may have to be sacrificed because of the pH of the aqueous composition during the contacting which pH may be preferred for various processing reasons. This reduced complex stability has surprisingly been found not to have an undue adverse effect on oxidation. The particular pH employed can also affect the salt form of the complexing agent employed, and such complexing salts are complexing agents within the scope of this invention.

The present contacting occurs at conditions effective to (1) chemically oxidize at least a portion of the carbonaceous material in the ore and (2) at least partially liberate the first metal from the ore. By "liberated from the ore" is meant that the desired first metal in the ore after the present contacting can be more effectively recovered using conventional (e.g., cyanide extraction) processing relative to the uncontacted ore. In certain instances, at least a portion of the carbonaceous material in the ore normally acts in a manner akin to activated carbon to "pick-up" the first metal after it has been extracted by cyanidation, thus impeding or reducing the overall recovery or yield of the first metal. The term "liberated from the ore" is meant to include reducing this "activated carbon" and/or the complexing effect to provide improved yields of first metal in the metal recovery step, i.e., the first metal becomes more amenable to recovery. This contacting preferably leads to a metal recovery step which involves reduced operating and capital costs and/or provides increased yields of first metal relative to recovering first metal from an uncontacted ore. The present contacting preferably acts to oxidize carbonaceous material in the ore, render an increased amount (relative to uncontacted ore) of the first metal in the ore amenable to conventional (cyanide extraction) metal recovery, and provide for a more effective and/or effective first metal recovery step.

The present contacting preferably takes place in the presence of an aqueous medium or composition. The added metal component or components, which are preferably soluble in the aqueous medium, may be added to mate admixture is formed into agglomerates by conventional processing, such as extruding, pilling, tableting and the like.

The agglomerates are placed on a pad, to form a heap which is built up by addition of agglomerates, preferably over a period of time in the range of about 15 days to about 60 days. During the time the heap is being built up, and preferably for a period of time ranging up to about 3 months, more preferably about 1 month to about 3 months after the last agglomerates are added to the heap, an aqueous medium containing the added metal component is made to flow through the heap, e.g., from the top to the bottom of the heap. If desired, air or other gaseous additional oxidant can be contacted with the heap during the contacting. After contacting the heap, the aqueous medium is collected and processed for disposal, processed for second metal and/or added metal recovery, and/or added metal component regeneration, and/or recycled to the heap. This contacting provides another important benefit in that at least a portion of the "cyanacides," such as copper, which may be present in the ore and/or metal sulfide-containing material is removed and/or deactivated. Such "cyanacides" cause substantial increases in cyanide consumption if present in cyanide extraction processing. Therefore, removing and/or deactivating cyanacides in the present contacting step provides for more effective metals recovery by cyanide extraction.

After the heap-aqueous composition contacting has proceeded to the desired extent, an aqueous basic (e.g., white lime, milk of lime or the like basic components) composition is contacted with the heap to neutralize the heap if a pH below 7 was used. After this neutralization, the agglomerates may be placed on a second heap, which is preferably larger than the heap previously described.

In addition, the neutralized agglomerates may be broken apart and reagglomerated prior to being placed on the second heap to provide for any incidental acid neutralization (if required) and/or to expose the treated ore for subsequent cyanidation. This can be done using conventional means, such as subjecting the agglomerates to grinding, milling or the like processing, and then forming the second agglomerates by extruding, tableting, pilling, pelletizing or the like processing.

In any event, if a second, preferably larger, heap is formed on a pad, then a dilute aqueous cyanide, preferably sodium cyanide, solution is made to contact the second heap. Typically, this cyanide contacting is performed in the presence of air. Preferably, the cyanide solution is percolated through the second heap. The cyanide solution, after being contacted with the second heap, contains the first metal. This solution is collected and sent to conventional further processing for recovery of the first metal.

Both heaps are preferably maintained at ambient conditions, e.g., of temperature and pressure. Also, both heaps may be built up and worked (contacted) with the aqueous contacting solutions and the cyanide solution for as long as the economics of the particular application involved remain favorable.

When an agitated leach in vessels is used for the process, contact times may vary depending, for example, on the specific ore being contacted, the other components present during the contacting and the degree of metal recovery desired. Contact times in the range of about 5 minutes or less to about 48 hours or more may be used. Preferably, the contact time is in the range of about 4 hours to about 36 hours, more preferably about 8 hours to about 24 hours. During this time, agitation can be advantageously employed to enhance contacting. Known mechanical mixers can be employed.

While the present invention has been described with respect to various specific examples and embodiments, it is to be understood that the present invention is not limited thereto and that it can be variously practiced within the scope of the following claims.

The embodiments of the present invention in which an exclusive property or privilege is claimed are as follows:

1. A process for recovering at least one first metal selected from the group consisting of gold, silver, the platinum group metals and mixtures thereof from an ore containing carbonaceous material comprising: contacting said ore with at least one component including an added metal in an amount effective to at least promote the oxidation of said carbonaceous material and at least one oxidant in an amount effective to provide at least one of the following: (A) form said component including said added metal, (B) regenerate said component including said added metal, and (C) oxidize said carbonaceous material, said contacting occurring in the presence of an aqueous medium at conditions effective to (1) chemically oxidize said carbonaceous material and (2) liberate said first metal from said ore, said component including said added metal being selected from the group consisting of iron complexes with ligands in which iron is present in an amount in the 3+ oxidation state effective to at least promote the oxidation of said carbonaceous material in said ore, copper complexes with ligands in which copper is present in an amount in the 2+ oxidation state effective to at least promote the oxidation of said carbonaceous material in said ore, vanadium components in which vanadium is present in the 5+ oxidation state in an amount effective to at least promote the oxidation of said carbonaceous material in said ore, manganese complexes with ligands in which manganese is present in the 3+ oxidation state in an amount effective to at least promote the oxidation of said carbonaceous material in said ore, and mixtures thereof; and recovering said first metal from said ore.

2. The process of claim 1 wherein said component including said added metal is selected from the group consisting of iron complexes with ligands, copper complexes with ligands and mixtures thereof, and said contacting takes place at a temperature in the range of about 20° C. to 140° C.

3. The process of claim 1 wherein said component including said added metal is selected from the group consisting of vanadium components in which vanadium is present in the 5+ oxidation state in an amount effective to at least promote the oxidation of said carbonaceous material in said ore, manganese complexes with ligands in which manganese is present in the 3+ oxidation state in an amount effective to at least promote the oxidation of said carbonaceous material in said ore, and mixtures thereof.

4. The process of claim 1 wherein the amount of said component including said added metal present during said contacting is less than about 2%, based on the amount of said ore present.

5. The process of claim 1 wherein said first metal is gold.

6. The process of claim 1 wherein said contacting occurs in the presence of an aqueous medium having a pH in the range of about 1 to about 10.

7. The process of claim 5 wherein said aqueous medium has a pH in the range of about 1 to about 10.

8. The process of claim 1 wherein said aqueous medium has a pH in the range of about 2 to about 8.

9. The process of claim 5 wherein said contacting occurs in the presence of an aqueous medium having a pH is the range of about 2 to about 8.

10. The process of claim 1 wherein said oxidant is selected from the group consisting of molecular oxygen, singlet oxygen, ozone, oxidant components containing oxygen and at least one second metal, and mixtures thereof.

11. The process of claim 10 wherein said second metal is selected from the group consisting of transition metals, rare earth metals and mixtures thereof.

12. The process of claim 11 wherein said additional oxidant is molecular oxygen, oxidant components containing oxygen and at least one second metal, and mixtures thereof.

13. The process of claim 11 wherein said additional oxidant is selected from the group consisting of oxidant components containing oxygen and at least one second metal, and mixtures thereof.

14. The process of claim 10 wherein said second metal is manganese.

15. The process of claim 14 wherein said manganese is in the 4+ oxidation state.

16. The process of claim 10 wherein said oxidant component is manganese dioxide.

17. The process of claim 15 wherein said oxidant component is manganese dioxide.

18. The process of claim 3 wherein said vanadium components are selected from vanadium complexes with ligands.

19. The process of claim 1 wherein said contacting occurs at a temperature in the range of about 20° C. to 140° C.

20. The process of claim 1 wherein said contacting occurs at a temperature in the range of about 20° C. to about 110° C.

21. The process of claim 1 wherein said contacting occurs at a temperature in the range of about 25° C. to about 80° C.

22. The process of claim 1 wherein said component of said added metal is present in said contacting in an amount in the range of about 10ppm. to about 1% by weight based on the weight of said ore, calculated as elemental metal.

23. The process of claim 1 wherein said recovering step comprises contacting said ore with aqueous cyanide solution to solubilize said first metal.

24. The process of claim 1 wherein said ore is placed to form a first heap which is contacted with said aqueous medium.

25. The process of claim 1 wherein said contacting occurs in a slurry containing said ore and said aqueous composition.

26. The process of claim 8 wherein said contacting occurs in a slurry containing said ore, said oxidant and said aqueous composition.

27. The process of claim 6 wherein said recovering step comprises contacting said ore with aqueous cyanide solution to solubilize said first metal.

28. The process of claim 6 wherein said recovering step comprises contacting said ore with aqueous cyanide solution to solubilize said first metal.

29. The process of claim 25 wherein said recovering step comprises contacting said ore with aqueous cyanide solution to solubilize sid first metal.

30. The process of claim 26 wherein said recovering step comprises contacting said ore with aqueous cyanide solution to solubilize said first metal.

31. The process of claim 24 wherein said recovering step comprises contacting said ore with aqueous cyanide solution to solubilize said first metal.

* * * * *

UNITED STATES PATENT AND TRADEMARK OFFICE

CERTIFICATE OF CORRECTION

PATENT NO. : 4,801,329

DATED : January 31, 1989

INVENTOR(S) : Clough et al

It is certified that error appears in the above-identified patent and that said Letters Patent is hereby corrected as shown below:

Column 11, line 17; delete "additional"

Column 11, line 21; delete "additional"

Signed and Sealed this

Twentieth Day of June, 1989

*Attest:*

DONALD J. QUIGG

*Attesting Officer*

*Commissioner of Patents and Trademarks*